US009915186B2

(12) United States Patent
Lavertu

(10) Patent No.: US 9,915,186 B2
(45) Date of Patent: Mar. 13, 2018

(54) EXHAUST AFTER-TREATMENT SYSTEM

(71) Applicant: General Electric Company, Schenectady, NY (US)

(72) Inventor: Thomas Michael Lavertu, Clifton Park, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/248,635

(22) Filed: Apr. 9, 2014

(65) Prior Publication Data

US 2015/0292388 A1 Oct. 15, 2015

(51) Int. Cl.

| | |
|---|---|
| ***F01N 3/00*** | (2006.01) |
| ***F01N 5/04*** | (2006.01) |
| ***F01N 13/10*** | (2010.01) |
| ***F01N 3/08*** | (2006.01) |
| *F02M 26/43* | (2016.01) |
| *F02M 26/23* | (2016.01) |

(52) U.S. Cl.

CPC ..... *F01N 13/107* (2013.01); *F01N 3/08* (2013.01); *F01N 2340/06* (2013.01); *F01N 2410/00* (2013.01); *F02M 26/23* (2016.02); *F02M 26/43* (2016.02)

(58) Field of Classification Search

CPC .... F01N 3/2053; F01N 3/0842; F01N 3/0871; F01N 13/107; F01N 3/08; F01N 2340/06; F01N 2410/00; F02M 25/0718; F02M 25/074; F02M 26/43; F02M 26/23

USPC ..... 60/274, 276, 278, 280, 285, 324

See application file for complete search history.

(56) References Cited

U.S. PATENT DOCUMENTS

| | | | | |
|---|---|---|---|---|
| 6,155,042 | A * | 12/2000 | Perset et al. | 60/278 |
| 6,557,341 | B2 * | 5/2003 | Bubeck et al. | 60/284 |
| 7,367,180 | B2 * | 5/2008 | Surnilla et al. | 60/285 |
| 8,056,337 | B2 * | 11/2011 | Hokuto et al. | 60/602 |
| 8,250,857 | B2 | 8/2012 | Driscoll et al. | |
| 8,286,418 | B2 * | 10/2012 | Demura | 60/285 |
| 8,341,949 | B2 | 1/2013 | Tarabulski | |
| 2007/0130946 | A1 * | 6/2007 | Winsor et al. | 60/605.1 |
| 2012/0180476 | A1 | 7/2012 | Steiner et al. | |

(Continued)

OTHER PUBLICATIONS

Subramaniam et al., "Feasibility Assessment of a Pre-turbo After-Treatment System with a 1D Modeling Approach", World Congress & Exhibition, 2009-01-1276, 14 Pages.

(Continued)

*Primary Examiner* — Phutthiwat Wongwian
*Assistant Examiner* — Diem Tran
(74) *Attorney, Agent, or Firm* — John P. Darling

(57) ABSTRACT

An engine having an after-treatment system for reducing emissions from an exhaust stream includes an intake manifold and a plurality of cylinders coupled to the intake manifold. The plurality of cylinders includes a first set of cylinders and a second set of cylinders. Further, the engine includes a first exhaust manifold coupled to the first set of cylinders and a second exhaust manifold coupled to the second set of cylinders. The engine further includes an after-treatment system coupled to the first exhaust manifold. The first exhaust manifold further includes an end portion disposed downstream relative to the after-treatment system. The end portion of the first exhaust manifold is coupled to a first portion of the second exhaust manifold via a pipe.

21 Claims, 6 Drawing Sheets

(56) References Cited

U.S. PATENT DOCUMENTS

| | | | |
|---|---|---|---|
| 2013/0031891 | A1 | 2/2013 | Ponnathpur |
| 2013/0067891 | A1 | 3/2013 | Hittle et al. |
| 2013/0125524 | A1 | 5/2013 | Plummer et al. |

OTHER PUBLICATIONS

Downey et al., "Large Engine Aftertreatment in a Pre-Turbine Position: A Path to Compact and Cost-Effective Emissions Reduction", ASME 2010 Internal Combustion Engine Division Fall Technical Conference, pp. 517-524.

Disclosed Anonymously, "Removable Aftertreatment System", IP.com No. IPCOM000212792D,The IP.com Prior Art Database, Nov. 2011, 6 Pages.

Brüstle et al.,"Aftertreatment in a Pre-Turbo Position: Size and Fuel Consumption Advantage for Tier 4 Large-Bore Diesel Engines", Aachen Colloquium Automobile and Engine Technology, 2011, 22 Pages.

* cited by examiner

EXHAUST AFTER-TREATMENT SYSTEM

BACKGROUND

The present patent application relates generally to an exhaust treatment system, and more particularly, an engine having an after-treatment system to selectively receive an exhaust stream to remove or convert emissions.

Engine may include an after-treatment system to remove certain emissions from an exhaust stream released from a plurality of cylinders of the engine. Such after-treatment systems needs to be properly sized to create reasonable pressure drop to the exhaust stream such that the space velocity is conducive for removing or converting the emissions. Generally, the cylinders of the engine are configured such that an entire exhaust stream flows through the after-treatment system necessitating a larger after-treatment system to efficiently handle the entire exhaust stream.

However, such larger after-treatment systems increase costs and occupy more space in the engine. Also, such larger after-treatment systems may not be durable and efficient as the entire exhaust stream needs be handled throughout the operation of the engine. Accordingly, there is a need to effectively handle exhaust stream and also have an improved exhaust treatment system.

BRIEF DESCRIPTION

In accordance with one exemplary embodiment, an engine having an after-treatment system includes an intake manifold and a plurality of cylinders coupled to the intake manifold. The plurality of cylinders includes a first set of cylinders and a second set of cylinders. The engine further includes a first exhaust manifold coupled to the first set of cylinders and a second exhaust manifold coupled to the second set of cylinders. Further, the engine includes the after-treatment system coupled to the first exhaust manifold. The first exhaust manifold includes an end portion which is disposed downstream relative to the after-treatment system and coupled to a first portion of the second exhaust manifold via a pipe.

In accordance with another exemplary embodiment, a method for treatment of an exhaust includes receiving a fuel and air stream into a plurality of cylinders, releasing a first exhaust stream from a first set of cylinders among the plurality of cylinders into a first exhaust manifold and an after-treatment system coupled to the first exhaust manifold. Further, the method includes releasing a second exhaust stream from a second set of cylinders among the plurality of cylinders into a second exhaust manifold and removing a plurality of components from the first exhaust stream via the after-treatment system and producing a third exhaust stream. Further, the method includes releasing the third exhaust stream from an end portion of the first exhaust manifold, into a first portion of the second exhaust manifold. The end portion is disposed downstream relative to the after-treatment system and coupled to the first portion of the second exhaust manifold via a pipe.

In accordance with yet another exemplary embodiment, a system having an after-treatment system as disclosed herein includes a compressor, an engine, and a turbine. The engine includes an intake manifold coupled to the compressor. The engine further includes a plurality of cylinders coupled to the intake manifold. Further, the engine includes a first exhaust manifold coupled to a first set of cylinders among the plurality of cylinders and a second exhaust manifold coupled to a second set of cylinders among the plurality of cylinders. Further, the engine includes an after-treatment system coupled to the first exhaust manifold. The first exhaust manifold includes an end portion which is disposed downstream relative to the after-treatment system and coupled to a first portion of the second exhaust manifold via a pipe. The system further includes a turbine coupled to second exhaust manifold and an outlet manifold.

DRAWINGS

These and other features and aspects of embodiments of the present disclosure will become better understood when the following detailed description is read with reference to the accompanying drawings in which like characters represent like parts throughout the drawings, wherein.

Figure 1:
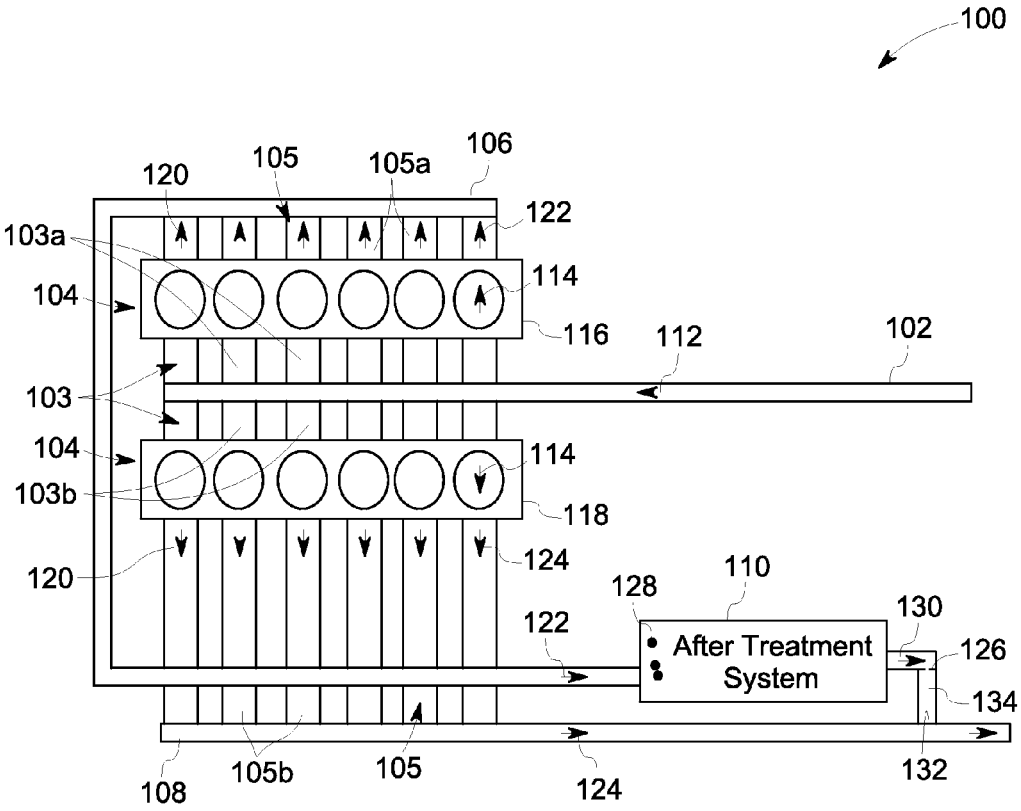
FIG. 1 illustrates a schematic view of an engine having an after-treatment system in accordance with one exemplary embodiment.
Figure 2:
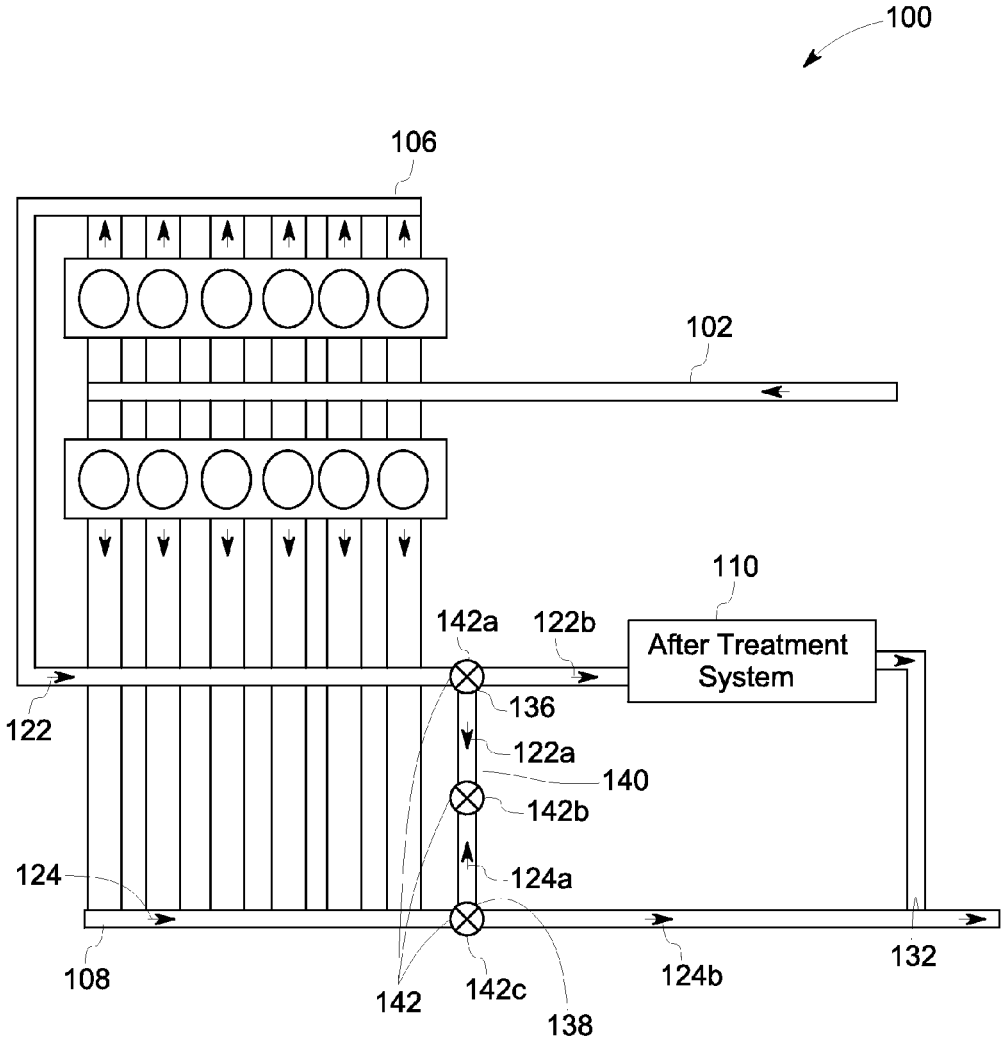
FIG. 2 illustrates a schematic view of the engine having the after-treatment system and a first valve in accordance with the exemplary embodiment of FIG. 1.
Figure 3:
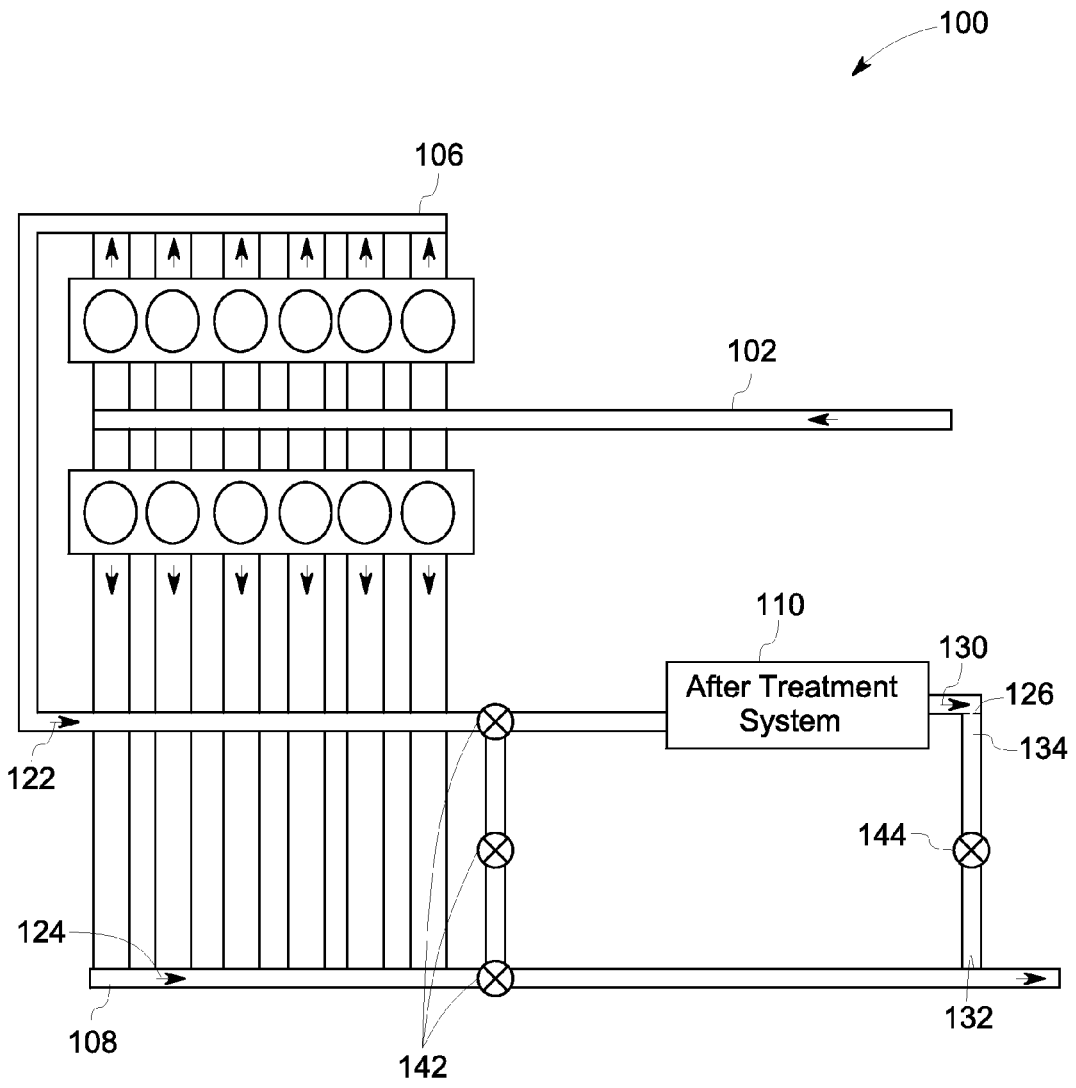
FIG. 3 illustrates a schematic view of the engine having the after-treatment system, the first valve, and a second valve in accordance with the exemplary embodiments of FIGS. 1 and 2.
Figure 5:
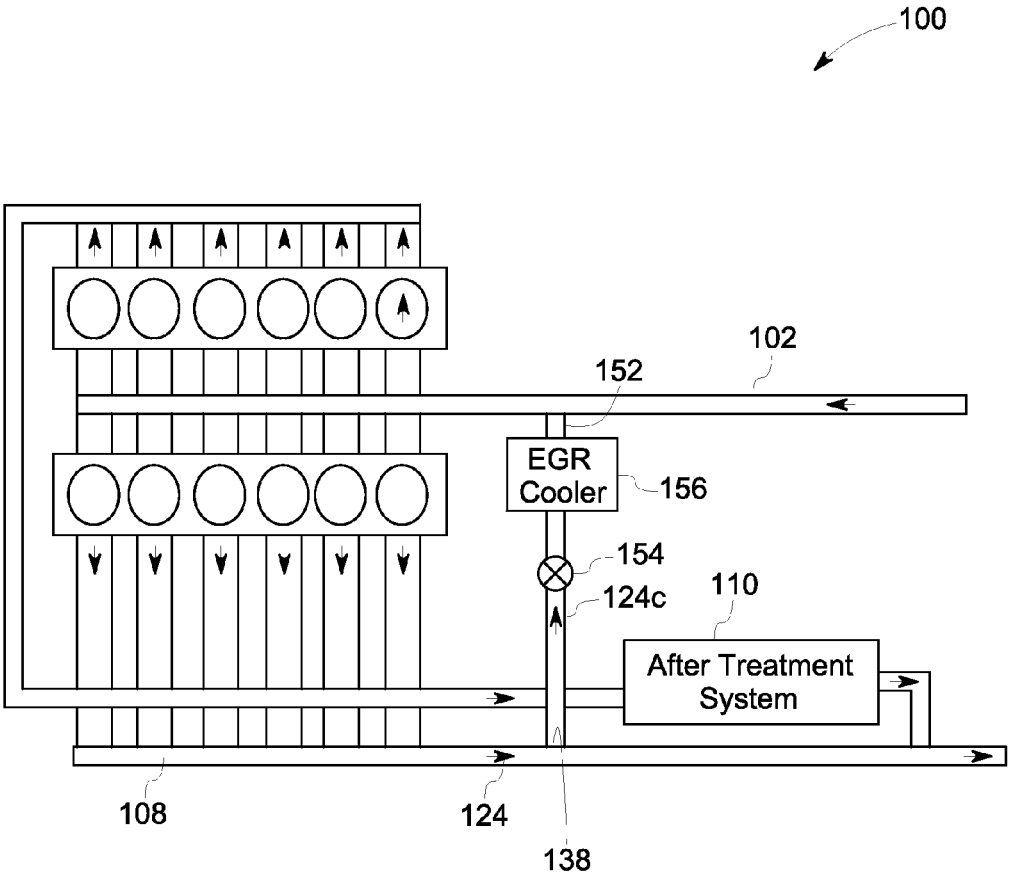
Figure 6:
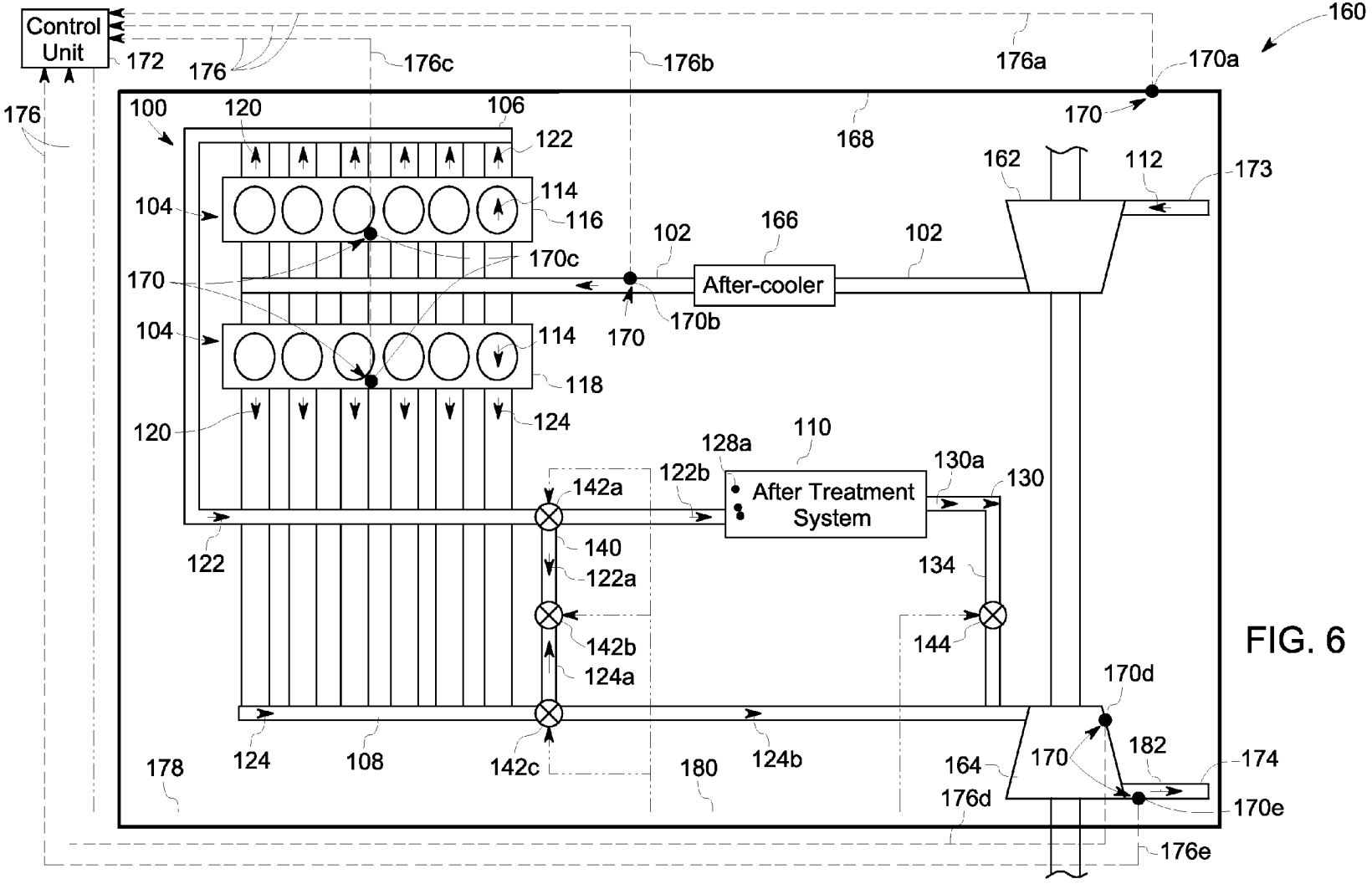

FIG. 5 illustrates a schematic view of an engine having an after-treatment system and an exhaust gas re-circulation loop coupled to a second exhaust manifold in accordance with the exemplary embodiment of FIG. 1; and FIG. 6 illustrates a schematic view of a system having the engine, the after-treatment system, the first control valve, the second control valve, and a control unit in accordance with the exemplary embodiments of FIGS. 1, 2, and 3.

DETAILED DESCRIPTION

FIG. 1 represents an engine 100 that includes an intake manifold 102, a plurality of cylinders 104, a first exhaust manifold 106, a second exhaust manifold 108, and an after-treatment system 110. The engine 100 may be a dual-fuel engine or a multi-fuel engine. The engine may be used to drive, for example, generators, commercial vehicles, machines, ships, locomotives, and the like.

The intake manifold 102 is coupled to the plurality of cylinders 104 via a plurality of inlet ports 103. The plurality of inlet ports 103 include a first set of inlet ports 103*a* and a second set of inlet ports 103*b*. The intake manifold 102 is further coupled to a compressor (not shown in FIG. 1) to supply a medium 112 e.g. air in a compressed state into each cylinder among the plurality of cylinders 104. The intake manifold 102 functions as a duct to supply the air 112 into each cylinder 104. Further, each cylinder 104 includes a fuel injector (not shown in FIG. 1) to inject a stream of fuel 114 into each cylinder 104. The intake manifold 102 may be configured to feed a mixture of air 112 and fuel 114 into each cylinder 104.

The plurality of cylinders 104 includes a first set of cylinders 116 and a second set of cylinders 118. Each cylinder among the first and second set of cylinders 116, 118 is coupled to the intake manifold 102 via the first and second set of inlet ports 103*a*, 103*b* respectively. In such embodiment, the first and second set of cylinders 116, 118 receive the same medium e.g. air 112 from the intake manifold 102.

Alternatively, each cylinder among the first set of cylinders 116 may be coupled to a first intake manifold (not shown in FIG. 1) via the first set of inlet ports 103*a* and each cylinder among the second set of cylinders 118 may be coupled to a second intake manifold (not shown in FIG. 1) via the second set of inlet ports 103*b*. In such embodiments, each cylinder among the first and second set of cylinders 116, 118 may receive different medium e.g. air, natural gas, hydrogen, and the like from the first and second intake manifolds respectively. The number of cylinders in the first and second set of cylinders 116, 118 may vary depending on the application and design criteria.

The fuel 114 may include a petrol, a diesel, a natural gas (i.e. compressed natural gas), a liquefied petroleum gas (LPG), hydrogen, and the like.

The engine 100 includes a plurality of pistons (not shown in FIG. 1), where each piston is coupled to and disposed within the corresponding cylinder 104. During operation, each piston reciprocates within the corresponding cylinder 104 and produces an exhaust stream 120 by combustion of the fuel 114 and air 112 within each cylinder 104.

The plurality of cylinders 104 is further coupled to the first exhaust manifold 106 and the second exhaust manifold 108 via a plurality of outlet ports 105. The plurality of outlet ports 105 includes a first set of outlet ports 105*a* and a second set of outlet ports 105*b*. The first set of cylinders 116 is coupled to the first exhaust manifold 106 via the first set of outlet ports 105*a* and the second set of cylinders 118 is coupled to the second exhaust manifold 108 via the second set of outlet ports 105*b*. During operation, the plurality of cylinders 104 releases the exhaust stream 120 into the first and second exhaust manifolds 106, 108. The first set of cylinders 116 releases a first exhaust stream 122, into the first exhaust manifold 106 and the second set of cylinders 118 releases a second exhaust stream 124, into the second exhaust manifold 108.

The after-treatment system 110 is coupled to the first exhaust manifold 106 having an end portion 126. The after-treatment system 110 is coupled to the first exhaust manifold 106 such that the exhaust stream 120, specifically the first exhaust stream 122, flows through the after-treatment system 110.

The after-treatment system 110 may include one or more variety of emissions treatment technologies, such as diesel oxidation catalysts (DOCs), diesel particulate filters (DPFs), selective catalytic reduction catalysts (SCRs), lean nitrogen di-oxide traps (LNTs), and the like. During operation, the after-treatment system 110 removes a plurality of emissions 128 from the first exhaust stream 122 and produces a third exhaust stream 130. The after-treatment system 110 may use a catalytic process to convert the plurality of emissions 128 into another substance (not shown in FIG. 1), for example, water vapor, carbon di-oxide (CO2), and the like. The plurality of emissions 128 may include nitrogen oxide (NOx), carbon oxide (CO2), carbon monoxide (CO), hydrocarbons (HC), and the like. The after-treatment system 110 may remove the plurality of emissions 128 from the second exhaust stream 124 and produce the third exhaust stream 130.

The end portion 126 is disposed downstream relative to the after-treatment system 110. Further, the end portion 126 is an opening disposed at an end point of the first exhaust manifold 106. During operation, the end portion 126 functions as an exit port to discharge the third exhaust stream 130 from the first exhaust manifold 106.

The second exhaust manifold 108 has a first portion 132, such as an opening or a hole, formed substantially at an end point of the second exhaust manifold 108. During operation, the first portion 132 functions as a conduit to receive the third exhaust stream 130 from the end portion 126 of the first exhaust manifold 106.

The engine 100 further includes a pipe 134 or conduit coupling the end portion 126 of the first exhaust manifold 106 to the first portion 132 of the second exhaust manifold 108. During operation, the pipe 134 functions as a connector to channel the third exhaust stream 130 into the second exhaust manifold 108. The second exhaust manifold 108 is further coupled to a turbine (not shown in FIG. 1) for expansion of at least one of the first, the second, and the third exhaust stream 122, 124, 130.

FIG. 2 illustrates the engine 100 having the after-treatment system 110 in accordance with the exemplary embodiment of FIG. 1 and further including an intermediate portion 136 formed substantially at a mid-point of the first exhaust manifold 106. The intermediate portion 136 is disposed upstream relative to the after-treatment system 110. The intermediate portion 136 may be an opening or a hole. During operation, the intermediate portion 136 functions either as an exit port to discharge at least a portion 122*a* of the first exhaust stream 122 from the first exhaust manifold 106 to the second exhaust manifold 108 or as an entry port to receive at least a portion 124*a* of the second exhaust stream 124 from the second exhaust manifold 108 to the first exhaust manifold 106.

Similarly, the second exhaust manifold 108 further has a second portion 138 formed substantially at a mid-point of the second exhaust manifold 108. The second portion 138 is disposed upstream relative to the first portion 132 of the second exhaust manifold 108. The second portion 138 may be an opening or hole. During operation, the second portion 138 functions either as another entry port to receive at least the portion 122*a* of the first exhaust stream 122 from the first exhaust manifold 106 or as another exit port to discharge at least the portion 124*a* of the second exhaust stream 124 from the second exhaust manifold 108 to the first exhaust manifold 106.

The engine 100 further includes a tube 140 or pipe or conduit coupled to the intermediate portion 136 of the first exhaust manifold 106 and second portion 138 of the second exhaust manifold 108. During operation, the tube 140 functions as another connector to channel either at least the portion 122*a* of the first exhaust stream 122 into the second exhaust manifold 108 or at least the portion 124*a* of the second exhaust stream 124 into the first exhaust manifold 106.

The engine 100 has valves 142 (herein also referred as "first valves") disposed on at least one of the tube 140, the intermediate portion 136, and the second portion 138. The valves 142 include at least one of a top valve 142*a*, an intermediate valve 142*b*, and a bottom valve 142*c*. The top valve 142*a* is disposed on the intermediate portion 136, the intermediate valve 142*b* is disposed on the tube 140, and the bottom valve 142*c* is disposed on the second portion 138. The valves 142*a*, 142*b*, 142*c* function in tandem to selectively allow the first and second exhaust streams 122, 124 to flow through the after-treatment system 110.

The valves 142 may be disposed only on the intermediate portion 136. The valves 142 may be disposed only on the second portion 138. The valves 142 may be disposed on the tube 140. Similarly, the valves 142 may be disposed only at two locations, for example, at the intermediate portion 136 and the tube 140 or for example at the second portion 138 and the tube 140. All such permutations and combinations of disposing the valves 142 at various locations are possible, and such variations may depend on the application and design criteria.

During operation, the top valve 142*a* will allow the first exhaust stream 122 to flow through the after-treatment system 110 and may allow the portion 124*a* of the second exhaust stream 124 from the second exhaust manifold 108 to flow through the after-treatment system 110. The top valve 142*a* may block the first exhaust stream 122 from flowing through the after-treatment system 110 and may allow the first exhaust stream 122 from flowing towards the second exhaust manifold 108. The top valve 142*a* may partially allow the portion 122*a* of the first exhaust stream 122 from the first exhaust manifold 106 to flow towards the second exhaust manifold 108 and another portion 122*b* of the first exhaust stream 122 to flow through the after-treatment system 110.

The intermediate valve 142*b* may allow the portion 122*a* of the first exhaust stream 122 from the first exhaust manifold 106 to flow towards the second exhaust manifold 108. The intermediate valve 142*a* may allow the portion 124*a* of the second exhaust stream 124 from the second exhaust manifold 108 to flow towards the first exhaust manifold 106.

The bottom valve 142*c* may allow the second exhaust stream 124 from flowing towards the second exhaust manifold 108 and may allow the portion 122*a* of the first exhaust stream 122 from the first exhaust manifold 106 to flow towards the second exhaust manifold 108. The bottom valve 142*c* may block the second exhaust stream 124 from flowing towards the second exhaust manifold 108 and may allow the second exhaust stream 124 from flowing towards the first exhaust manifold 106. The bottom valve 142*c* may partially allow the portion 124*a* of the second exhaust stream 124 from the second exhaust manifold 108 to flow towards the first exhaust manifold 106 and another portion 124*b* of the second exhaust stream 124 to flow through the second exhaust manifold 108.

FIG. 3 illustrates the engine 100 having the after-treatment system 110, the valves 142 in accordance with the exemplary embodiments of FIGS. 1 and 2 and further including a second valve 144 disposed on at least one of the pipe 134 and the end portion 126. The second valve 144 functions in tandem to allow the third exhaust stream 130 from the first exhaust manifold 106 to flow towards the second exhaust manifold 108.

The second valve 144 may be disposed on the pipe 134. The second valve 144 may be disposed at both locations, for example at the end portion 126 and the pipe 134. All such permutations and combinations of disposing the second valve 144 at various locations are possible and such variations may depend on the application and design criteria. During operation, the second valve 144 will allow the third exhaust stream 130 to flow from end portion 126 of the first exhaust manifold 106 to the first portion 132 of the second exhaust manifold 108 via the pipe 134.

Figure 4:
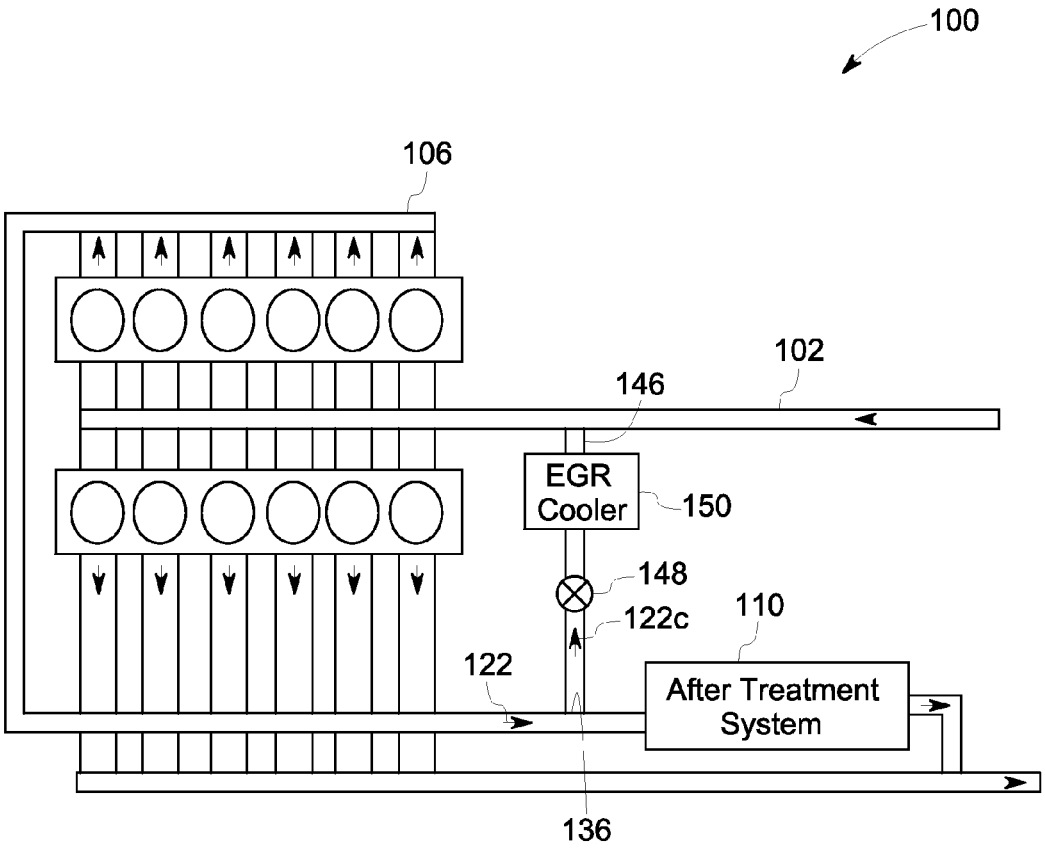
FIG. 4 illustrates a schematic view of the engine having the after-treatment system and an exhaust gas re-circulation loop coupled to a first exhaust manifold in accordance with the exemplary embodiment of FIG. 1.

FIG. 4 illustrates the engine 100 having the after-treatment system 110 in accordance with the exemplary embodiment of FIG. 1 and further including an exhaust gas recirculation (EGR) loop 146 coupled to the first exhaust manifold 106 and the intake manifold 102. The EGR loop 146 is coupled to the intermediate portion 136 of the first exhaust manifold 106. The EGR loop 146 functions as a connector to channel another portion 122*c* of the first exhaust stream 122 into the intake manifold 102.

The EGR loop 146 includes a valve 148, and an EGR cooler 150. The valve 148 may allow a partial flow of the other portion 122*c* of the first exhaust stream 122 from flowing towards the intake manifold 102 or block the other portion 122*c* of the first exhaust stream 122 from flowing towards the intake manifold 102. The EGR cooler 150 will cool the other portion 122*c* of the first exhaust stream 122 flowing in the EGR loop 146 before supplying to the intake manifold 102. The EGR cooler 150 may be connected to a cooling tower (not shown in FIG. 4) to supply a cold stream so as to cool the other portion 122*c* of the first exhaust stream 122. The other portion 122*c* flowing in the EGR cooler 150 may be further cooled via a cool air stream from a plurality of fans (not shown in FIG. 4) so as to absorb the heat from the other portion 122*c* and reject to an ambient environment. The opening and the closing of the valve 148 may vary depending on the application and design criteria.

FIG. 5 illustrates a schematic view of the engine 100 having the after-treatment system 110 in accordance with the exemplary embodiment of FIG. 1 and further including an exhaust gas re-circulation (EGR) loop 152 coupled to the second exhaust manifold 108 and the intake manifold 102. The EGR loop 152 is coupled to the second portion 138 of the second exhaust manifold 108. The EGR loop 152 functions as a connector to channel yet another portion 124*c* of the second exhaust stream 124 into the intake manifold 102.

The EGR loop 152 includes a valve 154, and an EGR cooler 156. The valve 154 may either allow a partial flow of the other portion 124*c* of the second exhaust stream 124 from flowing towards the intake manifold 102 or block the other portion 124*c* of the second exhaust stream 124 from flowing towards the intake manifold 102. The EGR cooler 156 will cool the other portion 124*c* of the second exhaust stream 124 flowing in the EGR loop 152 before supplying to the intake manifold 102. The EGR cooler 156 may be connected to a cooling tower (not shown in FIG. 5) to supply a cold stream so as to cool the other portion 124*c* of the second exhaust stream 124. The other portion 124*c* flowing in the EGR cooler 156 may be further cooled via a cool air stream from plurality of fans (not shown in FIG. 5) so as to absorb the heat from the other portion 124*c* and reject to an ambient environment. The opening and the closing of the valve 154 may vary depending on the application and design criteria.

FIG. 6 illustrates a schematic view of a system 160 having the engine 100 in accordance with the exemplary embodiments of FIGS. 1, 2, and 3. The system 160 may be a vehicle, such as a ship, a locomotive, and the like. The system 160 includes a compressor 162, a turbine 164, the engine 100, an after-cooler 166, a chassis 168, a plurality of sensors 170, and a control unit 172.

The compressor 162 is coupled to the intake manifold 102 of the engine 100, and an inlet manifold 173. The compressor 162 receives the air 112 from the inlet manifold 173 coupled to the fluid source (not shown in FIG. 6). The compressor 162 may receive the air 112 from the ambient atmosphere. The compressor 162 increases the pressure of the air 112 to a predetermined pressure level and supplies the air 112 in compressed state to the plurality of cylinders 104 via the intake manifold 102 and the plurality of inlet ports 103 (as shown in FIG. 1). The predetermined pressure level may be in a range from about 1 bar to about 8 bars. The predetermined pressure level may vary depending on the application and design criteria. The after-cooler 166 is coupled to the intake manifold 102, which cools the air 112 to a predetermined temperature level, before supplying to the plurality of cylinders 104. The predetermined temperature level may be in a range from about 100 F (about 37 C)

to about 250 F (about 121 C). The predetermined temperature level may vary depending on the application and design criteria.

The first set of cylinders 116 and the second set of cylinders 118 receive the compressed air 112 and the fuel 114. The combustion of the fuel 114 within each cylinder among the first and second set of cylinders 116, 118 results in generation of the exhaust stream 120. The first exhaust stream 122 is released from the first set of cylinders 116 to the first exhaust manifold 106 via the first set of outlet ports 105*a* (as shown in FIG. 1) and the second exhaust stream 124 is released from the second set of cylinders 118 to the second exhaust manifold 108 via the second set of outlet ports 105*b* (as shown in FIG. 1).

The plurality of sensors 170 includes a first sensor 170*a*, a second sensor 170*b*, a third sensor 170*c*, a fourth sensor 170*d*, and a fifth sensor 170*e*. The plurality of sensors 170 is disposed on the intake manifold 102, an outlet manifold 174, the turbine 164, the plurality of cylinders 104, and the chassis 168. The first sensor 170*a* is disposed on the chassis 168, the second sensor 170*b* is disposed on the intake manifold 102, the third sensor 170*c* is disposed on the plurality of cylinders 104, the fourth sensor 170*d* is disposed on the turbine 164, and the fifth sensor 170*e* is disposed on the outlet manifold 174. Each sensor 170 is communicatively coupled to the control unit 172. The control unit 172 is further communicatively coupled to the first valve 142, and the second valve 144. The control unit 172 is communicatively coupled to the valves 142.

The control unit 172 is a processor based device, which is configured to obtain an input signal 176 from at least one sensor among the plurality of sensors 170 and process the input signal 176 so as to generate a first output signal 178 to control the valves 142*a*, 142*b*, 142*c* and a second output signal 180 to control the second valve 144.

The input signal 176 may include at least one of a first input signal 176*a*, a second input signal 176*b*, a third input signal 176*c*, a fourth input signal 176*d*, and a fifth input signal 176*e*. The first input signal 176*a* is representative of at least one of ambient temperature, and ambient pressure of the system 160 obtained from the first sensor 170*a*. The second input signal 176*b* is representative of temperature of the air 112 at the inlet manifold 102, obtained from the second sensor 170*b*. The third input signal 176*c* is representative of fuel energy supplied to the plurality of cylinders 104 obtained from the third sensor 170*c*. The fourth input signal 176*d* is representative of speed of the system 160 obtained from the fourth sensor 170*d*. The fifth input signal 176*e* is representative of a level of hydrocarbons released via the outlet manifold 174, obtained from the fifth sensor 170*e*.

In a dual fuel engine, the fuel 114 supplied to the plurality of cylinders 104 may be natural gas and diesel. The fuel energy of the natural gas to the total fuel energy is in a range from about 40 percent to about 90 percent, and the diesel in a range from about 60 percent to about 10 percent. The fuel energy supplied to the plurality of cylinders 104 is determined by a time interval of the fuel injection valve (not shown in FIG. 6) opened for injecting the fuel 114 within each cylinder 104 and the pressure of the fuel 114 injected within each cylinder 104. Similarly, the level of hydrocarbons released via the outlet manifold 174 is determined based on mixing and combustion of the air 112 and the fuel 114 leading to the formation of the gaseous hydrocarbons in the outlet manifold 174. The level of hydrocarbon in the outlet manifold 174 is determined based on a hydrocarbon look-up table (Table-1). The gaseous hydrocarbons in the outlet manifold 174 may be determined using a hydrocarbon sensor 170*e* disposed in the outlet manifold 174.

TABLE 1

| Inlet Manifold | Outlet Manifold | Empirical data |
|---|---|---|
| Pressure: 1-5 bars<br>Temperature: 100-150 degree Fahrenheit<br>Fuel injected: 500-2200 mg/stroke | Pressure: 1-5 bars<br>Temperature: 900-1000 degree Fahrenheit<br>Air constituent (excess air ratio): 2.0 | <5 grams per horse power hour |

The sensor 170*e*, e.g. lambda sensor, provides input signal 176*e* representative of an excess air ratio, pressure and temperature of the exhaust streams 122, 124, 130 at the outlet manifold 174. The sensor 170*b* provides input signal 176*b* representative of pressure and temperature of the air stream 112 and sensor 170*c* provide input signal 176*c* representative of fuel injected or supplied into the plurality of cylinders 104. The input signals 176 are compared with the empirical data to determine the level of hydrocarbons released via the outlet manifold 174.

The control unit 172 is configured to process the input signal 176 by with an associated look-up table (Table-2) to generate the first output signal 178 to regulate the first valve 142 and the second output signal 180 to regulate the second valve 144.

TABLE 2

| Parameter | Range | |
|---|---|---|
| Ambient temperature of the system | 0 degree Fahrenheit | 105 degree Fahrenheit |
| Ambient pressure of the system | 11.3 psi | 15.7 psi |
| Fuel energy supplied to the plurality of cylinders | 50 percent | 80 percent |
| Temperature of the air stream in the intake manifold | 80 degree Fahrenheit | 200 degree Fahrenheit |
| Speed of the system [rpm] | 200 | 4500 |
| Level of hydrocarbons released via an outlet manifold | 20 percent | 40 percent |

The control unit 172 receives the input signal 176*a* from the sensor 170*a* which is representative of at least one of the a) ambient temperature of the system 160 in the range from about 40 degree Fahrenheit to about 105 degree Fahrenheit, and b) ambient pressure of the system 160 in the range from about 11.3 psi to about 15.7 psi. The control unit 172 processes the input signal 176*a* by comparing with the Table-2 to generate the first output signal 178 to control the flow of the first exhaust stream 122. The first output signal 178 regulates the top valve 142*a* to open partially so as to allow the portion 122*a* of the first exhaust stream 122 to bypass the after-treatment system 110. Further, the first output signal 178 regulates the intermediate valve 142*b* to open completely, and the bottom valve 142*c* to open partially so as to allow the portion 122*a* of the first exhaust stream 122 to flow into the second exhaust manifold 108. The other portion 122*b* of the first exhaust stream 122 will flow through the after-treatment system 110 so as to remove the plurality of components 128 (as shown in FIG. 1) or convert the plurality of components 128 into another substance (not shown in FIG. 1), and produce the third exhaust stream 130. The portion 122*a* of the first exhaust stream 122 is bypassed through the tube 140 connected to the intermediate portion 136 (as shown in FIG. 2) of the first exhaust manifold 106 and the second portion 138 (as shown in FIG. 2) of the second exhaust manifold 108.

The control unit 172 generates the second output signal 180 to control the flow of the third exhaust stream 130 into the second exhaust manifold 108. The second output signal 180 regulates the second valve 144 to open completely so as to allow the third exhaust stream 130 to flow into the second exhaust manifold 108. The third exhaust stream 130 flows through the pipe 134 connected to the end portion 126 (as shown in FIG. 1) of the first exhaust manifold 106 and the first portion 132 of the second exhaust manifold 108 (as shown in FIG. 1). The other portion 122*b* of the first exhaust stream 122, which flow through the after-treatment system 110, is in the range from about 20 percent to about 70 percent.

The control unit 172 may receive the input signal 176*e* from the sensor 170*e* which is representative of level of hydrocarbons released via an outlet manifold 174. The control unit 172 processes the input signal 176*e* by comparing with the Table-2 to generate the first output signal 178 to control the flow of the first exhaust stream 122. The first output signal 178 regulates the top valve 142*a* to open completely so as to allow the first exhaust stream 122 to flow completely through the first exhaust manifold 106. Further, the first output signal 178 regulates the intermediate valve 142*b* to open completely, and the bottom valve 142*c* to open partially so as to allow the portion 124*a* of the second exhaust stream 124 to flow into the first exhaust manifold 106. The bottom valve 142*c* further allows the other portion 124*b* of the second exhaust stream 124 to flow in the second exhaust manifold 108. The first exhaust stream 122 and the portion 124*a* of the second exhaust stream 124 passes through the after-treatment system 110 so as to remove/convert the plurality of components 128 (as shown in FIG. 1), another plurality of components 128*a* and produce the third exhaust stream 130, and another third exhaust stream 130. The portion 124*a* of the second exhaust stream 124 flows into the first exhaust manifold 106 through the tube 140 connected to the intermediate portion 136 (as shown in FIG. 2) of the first exhaust manifold 106 and the second portion 138 (as shown in FIG. 2) of the second exhaust manifold 108.

The plurality of components 128 and other plurality of components 128*a* may be identical. The term "plurality of components" and "other plurality of components" may be used interchangeably. Similarly, the third exhaust stream 130 and other third exhaust stream 130*a* may be identical. The term "third exhaust stream" and "other third exhaust stream" may be used interchangeably.

The control unit 172 generates the second output signal 180 to control the flow of the third exhaust stream 130 into the second exhaust manifold 108. The second output signal 180 regulates the second valve 144 to open completely so as to allow the third exhaust stream 130 to flow into the second exhaust manifold 108. The third exhaust stream 130 flows through the pipe 134 connected to the end portion 126 (as shown in FIG. 1) of the first exhaust manifold 106 and the first portion 132 (as shown in FIG. 1) of the second exhaust manifold 108. The portion 124*a* of the second exhaust stream 124 and the first exhaust stream 122, which passes through the after-treatment system 110, is in the range from about 50 percent to 70 percent.

The second exhaust manifold 108 is further coupled to the turbine 164. The turbine 164 receives at least one of the first exhaust stream 122, the second exhaust stream 124, and the third exhaust stream 130 from the second exhaust manifold 108. Further, the turbine 164 expands the received exhaust streams 122, 124, 130 and discharges an expanded exhaust stream 182 to a condenser (not shown in FIG. 6), atmosphere, and the like, via the outlet manifold 174.

In accordance with embodiments discussed herein, the system facilitates deployment of smaller sized after-treatment system, which eventually results in consuming less space within the engine. Further, by selectively allowing the exhaust stream to flow through the after-treatment system, the efficiency and durability of the after-treatment system is improved. The cost of the system is substantially reduced.

While only certain features of embodiments have been illustrated and described herein, many modifications and changes will occur to those skilled in the art. It is, therefore, to be understood that the appended claims are intended to cover all such modifications and changes.

The invention claimed is:

1. A method comprising:

receiving a fuel and a compressed air stream through an intake manifold, into a plurality of cylinders, wherein the plurality of cylinders comprises a first set of cylinders and a second set of cylinders;

releasing a first exhaust stream from the first set of cylinders, into a first exhaust manifold and a portion of the first exhaust stream through an after-treatment system coupled to the first exhaust manifold;

releasing a second exhaust stream from the second set of cylinders, into a second exhaust manifold;

removing or converting a plurality of components from the portion of the first exhaust stream and produce a third exhaust stream via the after-treatment system;

releasing the third exhaust stream from an end portion of the first exhaust manifold, into a first portion of the second exhaust manifold, wherein the end portion is disposed downstream relative to the after-treatment system, wherein the end portion is coupled to the first portion of the second exhaust manifold via a pipe; and feeding another portion of the first exhaust stream, a portion of the second exhaust stream, and the third exhaust stream to a turbine disposed downstream relative to the after-treatment system and coupled to the first portion of the second exhaust manifold that is downstream of the pipe of the third exhaust stream connected the end portion of the first exhaust manifold into the first portion of the second exhaust manifold, wherein the other portion of the first exhaust stream is fed from an intermediate portion of the first exhaust manifold to a second portion of the second exhaust manifold via a tube, bypassing the after-treatment system.

2. The method of claim 1, further comprising obtaining an input signal representative of at least one of ambient temperature of a system, ambient pressure of the system, temperature of the compressed air stream in the intake manifold, speed of the system, fuel energy supplied to the plurality of cylinders, and level of hydrocarbons released via an outlet manifold, from a plurality of sensors respectively.

3. The method of claim 2, further comprising generating a first output signal from a control unit based on the input signal obtained from the plurality of sensors; and releasing the other portion of the first exhaust stream from the intermediate portion of the first exhaust manifold into the second portion of the second exhaust manifold bypassing the after-treatment system, and another portion of the second exhaust stream from the second portion of the second exhaust manifold into the intermediate portion of the first exhaust manifold through the after-treatment system, via a first valve, wherein the first valve is disposed on at least one of the tube, the intermediate portion, and the second portion.

4. The method of claim 2, further comprising removing or converting another plurality of components from the other portion of the second exhaust stream and producing another third exhaust stream via the after-treatment system.

5. The method of claim 4, further comprising generating a second output signal from the control unit based on the input signal obtained from the plurality of sensors; and releasing the third exhaust stream and the other third exhaust stream from the end portion into the first portion via a second valve, wherein the second valve is disposed on the pipe or the end portion.

6. The method of claim 5, wherein generating comprises comparing the input signal obtained by the plurality of sensors with an associated look-up table.

7. The method of claim 1, wherein feeding the portion of the second exhaust stream comprises feeding the portion of the second exhaust stream via the second exhaust manifold to the turbine, bypassing the after-treatment system.

8. A system comprising:

a compressor;

an engine comprising:

an intake manifold coupled to the compressor; a plurality of cylinders coupled to the intake manifold;

a first exhaust manifold coupled to a first set of cylinders among the plurality of cylinders;

a second exhaust manifold coupled to a second set of cylinders among the plurality of cylinders; and an after-treatment system coupled to the first exhaust, manifold, wherein the first exhaust manifold comprises an end portion disposed downstream relative to the after-treatment system and coupled to a first portion of the second exhaust manifold via a pipe, and an intermediate portion of the first exhaust manifold coupled to a second portion of the second exhaust manifold via a tube, bypassing the after-treatment system; and a turbine disposed downstream relative to the after-treatment system and coupled to the first portion of the second exhaust manifold that is downstream of the pipe connected the end portion of the first exhaust manifold into the first portion of the second exhaust manifold.

9. The system of claim 8, wherein the after-treatment system is configured to remove or convert a plurality of components from a portion of the first exhaust stream to produce a third exhaust stream, wherein the first exhaust stream is released from the first set of cylinders, into the first exhaust manifold.

10. The system of claim 9, further comprising a plurality of sensors disposed on at least one of the intake manifold, the outlet manifold, the turbine, the plurality of cylinders, and a chassis.

11. The system of claim 10, wherein the plurality of sensors is configured to obtain an input signal representative of at least one of ambient temperature of a system, ambient pressure of the system, temperature of a compressed air stream in the intake manifold, speed of the system, fuel energy supplied to the plurality of cylinders, and level of hydrocarbons released via the outlet manifold.

12. The system of claim 11, further comprising a control unit communicatively coupled to the plurality of sensors, a first valve, and a second valve, wherein the first valve is disposed on at least one of the tube, the intermediate portion, and the second portion, and the second valve is disposed on the pipe or the end portion.

13. The system of claim 12, wherein the second exhaust manifold is configured to receive a second exhaust stream released from the second set of cylinders, wherein the first valve is configured to feed a portion of the second exhaust stream via the second exhaust manifold to the turbine, bypassing the after-treatment system.

14. The system of claim 13, wherein the control unit is configured to generate at least one of a first output signal and a second output signal based on the input signal obtained from the plurality of sensors; and release another portion of the first exhaust stream from the intermediate portion into the second portion bypassing the after-treatment system based on the first output signal, via the first valve, the other portion of the second exhaust stream from the second portion into the intermediate portion through the after-treatment system based on the first output signal, via the first valve, and the third exhaust stream from the end portion into the first portion based on the second output signal, via the second valve.

15. The system of claim 8, further comprising an exhaust gas re-circulation (EGR) loop coupled to the intermediate portion and the intake manifold, wherein the EGR loop comprises an EGR cooler.

16. The system of claim 8, further comprising an exhaust gas re-circulation (EGR) loop coupled to the second portion and the intake manifold, wherein the EGR loop comprises an EGR cooler.

17. A method for operating a system comprising an after-treatment system, the method comprising:

receiving a fuel and a compressed air stream through an intake manifold, into a plurality of cylinders, wherein the plurality of cylinders comprises a first set of cylinders and a second set of cylinders;

releasing a first exhaust stream from the first set of cylinders, into a first exhaust manifold and a portion of the first exhaust stream through the after-treatment system coupled to the first exhaust manifold;

releasing a second exhaust stream from the second set of cylinders, into a second exhaust manifold;

removing or converting a plurality of components from the portion of the first exhaust stream and produce a third exhaust stream via the after-treatment system;

releasing the third exhaust stream from an end portion of the first exhaust manifold, into a first portion of the second exhaust manifold, wherein the end portion is disposed downstream relative to the after-treatment system, wherein the end portion is coupled to the first portion of the second exhaust manifold via a pipe; and feeding another portion of the first exhaust stream, a portion of the second exhaust stream, and the third exhaust stream to a turbine disposed downstream relative to the after-treatment system and coupled to the first portion of the second exhaust manifold that is downstream of the pipe of the third exhaust stream connected the end portion of the first exhaust manifold into the first portion of the second exhaust manifold, wherein the other portion of the first exhaust stream is fed from an intermediate portion of the first exhaust manifold to a second portion of the second exhaust manifold via a tube, bypassing the after-treatment system.

18. The method of claim 17, further comprising:

obtaining an input signal representative of at least one of ambient temperature of a system, ambient pressure of the system, temperature of the compressed air stream in tire intake manifold, speed of the system, fuel energy supplied to the plurality of cylinders, and level of hydrocarbons released via an outlet manifold, from a plurality of sensors respectively;

generating a first output signal from a control unit based on the input signal obtained from the plurality of sensors; and releasing the other portion of the first exhaust stream from the intermediate portion of the first exhaust manifold into the second portion of the second exhaust manifold bypassing the after-treatment system, and another portion of the second exhaust stream from the second portion of the second exhaust manifold into the intermediate portion of the first exhaust manifold through the after-treatment system, via a first valve, wherein the first valve is disposed on at least one of the tube, the intermediate portion, and the second portion.

19. The method of claim 18, further comprising:

removing or converting another plurality of components from the other portion of the second exhaust stream and produce another third exhaust stream via the after-treatment system.

20. The method of claim 19, further comprising:

generating a second output signal from the control unit based on the input signal obtained from the plurality of sensors; and releasing the third exhaust stream and the other third exhaust stream from the end portion into the first portion via a second valve, wherein the second valve is disposed on the pipe or the end portion.

21. A method comprising:

receiving a fuel and a compressed air stream through an intake manifold, into a plurality of cylinders, wherein the plurality of cylinders comprises a first set of cylinders and a second set of cylinders;

releasing a first exhaust stream from the first set of cylinders, into a first exhaust manifold and a portion of the first exhaust stream through an after-treatment system coupled to the first exhaust manifold;

releasing a second exhaust stream from the second set of cylinders into a second exhaust manifold;

removing or converting a plurality of components from the portion of the first exhaust stream and produce a third exhaust stream via the after-treatment system;

releasing the third exhaust stream from an end portion of the first exhaust manifold, into a first portion of the second exhaust manifold, wherein the end portion is disposed downstream relative to the after-treatment system, wherein the end-portion is coupled to the first portion of the second exhaust manifold via a pipe; and feeding another portion of the first exhaust stream, a portion of the second exhaust stream, and the third exhaust stream to a turbine disposed downstream relative to the after-treatment system and coupled to the first portion of the second exhaust manifold that is downstream of the pipe of the third exhaust stream connected the end portion of the first exhaust manifold into the first portion of the second exhaust manifold, wherein the other portion of the first exhaust stream is fed from an intermediate portion of the first exhaust manifold to a second portion of the second exhaust manifold via a tube, bypassing the after-treatment system.

* * * * *